US012624889B2

(12) United States Patent
Ye

(10) Patent No.: US 12,624,889 B2
(45) Date of Patent: May 12, 2026

(54) REFRIGERATOR COMPRISING A CONTAINER

(71) Applicant: LG ELECTRONICS INC., Seoul (KR)

(72) Inventor: Kwang Young Ye, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 154 days.

(21) Appl. No.: 18/119,946

(22) Filed: Mar. 10, 2023

(65) Prior Publication Data

US 2023/0288134 A1 Sep. 14, 2023

(30) Foreign Application Priority Data

Mar. 11, 2022 (KR) ..... 10-2022-0031047

(51) Int. Cl.

| | |
|---|---|
| ***F25D 25/02*** | (2006.01) |
| ***F25D 25/00*** | (2006.01) |
| *A47B 96/02* | (2006.01) |
| *F25D 23/06* | (2006.01) |
| *F25D 23/12* | (2006.01) |

(52) U.S. Cl.

CPC ..... *F25D 25/021* (2013.01); *F25D 25/005* (2013.01); *F25D 25/025* (2013.01); *A47B 96/025* (2013.01); *A47B 2210/175* (2013.01); *F25D 23/065* (2013.01); *F25D 23/12* (2013.01); *F25D 2325/021* (2013.01)

(58) Field of Classification Search

CPC ..... F25D 23/12; F25D 23/065; F25D 25/021; F25D 25/025; F25D 23/067; F25D 25/00502; F25D 2325/021; A47B 88/402; A47B 88/407

See application file for complete search history.

(56) References Cited

U.S. PATENT DOCUMENTS

| | | | | |
|---|---|---|---|---|
| 3,241,334 A * | 3/1966 | Amore | F25D 25/021 | 62/412 |
| 3,339,994 A * | 9/1967 | Reddig | F25D 25/021 | 312/351 |
| 2007/0035221 A1* | 2/2007 | Koo | F25D 23/021 | 312/401 |
| 2016/0069607 A1* | 3/2016 | Johnson | F25D 23/067 | 312/317.1 |

(Continued)

FOREIGN PATENT DOCUMENTS

| | | |
|---|---|---|
| CN | 102721252 | 10/2012 |
| CN | 208075432 U * | 11/2018 |

(Continued)

OTHER PUBLICATIONS

Extended European Search Report dated Jul. 3, 2023 issued in Application No. 23160900.9.

*Primary Examiner* — Kimberley S Wright

(74) *Attorney, Agent, or Firm* — KED & ASSOCIATES, LLP

(57) ABSTRACT

A refrigerator of one embodiment includes a cabinet forming a storage, a first guide means being disposed in the storage, a holder being detachably coupled to the first guide means and including a second guide means configured to guide movement in a first direction, and a storing part defining a storage space, being coupled to the holder, and movable in a second direction different from the first direction.

10 Claims, 12 Drawing Sheets

(56) References Cited

U.S. PATENT DOCUMENTS

2016/0334159 A1* 11/2016 Hong ..... F25D 11/022

FOREIGN PATENT DOCUMENTS

| | | | | |
|---|---|---|---|---|
| DE | 102011077371 | | 9/1989 | |
| DE | 8909401 | | 10/1990 | |
| DE | 9011291 | | 10/1994 | |
| DE | 9218614 | | 12/2012 | |
| EP | 2581693 | | 4/2013 | |
| KR | 200290168 | Y1 * | 1/2003 | ..... F25D 25/025 |
| KR | 20040100494 | | 12/2004 | |
| KR | 10-0643395 | B1 | 11/2006 | |
| KR | 20100004410 | | 1/2010 | |
| KR | 10-2010-0072421 | A | 7/2010 | |
| KR | 101529442 | B1 * | 6/2015 | |

* cited by examiner

REFRIGERATOR COMPRISING A CONTAINER

CROSS-REFERENCE TO RELATED APPLICATION

This application claims priority under 35 U.S.C. § 119 to Korean Application No. 10-2022-0031047 filed on Mar. 11, 2022, whose entire disclosure is hereby incorporated by reference.

BACKGROUND

1. Field

Disclosed herein is a refrigerator comprising a detachable storing part.

2. Background

Refrigerators generate cold air by circulating refrigerants and provide the cold air to a storage compartment such as a refrigerator compartment or a freezer compartment, to store various types of storage targets for a long period of time and keep the storage targets fresh in the storage compartment. A refrigerator operates based on a refrigeration cycle in which refrigerants pass through a compressor, a condenser, an expansion valve and an evaporator. The refrigerants take away heat from the refrigerator while refrigerant liquids turn into refrigerant gases in the evaporator, such that cold air to be provided to a refrigerator compartment and a freezer compartment is generated.

An ordinary refrigerator comprises a plurality of storage spaces to sort and store a various types of storage targets. Specifically, the refrigerator can comprise a plurality of shelves, a plurality of storage drawers for storing vegetables and the like, and the like.

There are times when a small amount of storage targets such as unfrozen meat, eggs, or left vegetables and the like needs to be sorted and stored in a space different from the space in which other food items are stored. In this context, various types of items and refrigerators comprising the items have been suggested to store a small amount of storage targets separately.

BRIEF DESCRIPTION OF THE DRAWINGS

The embodiments will be described in detail with reference to the following drawings in which like reference numerals refer to like elements wherein.

DETAILED DESCRIPTION

Figure 1:
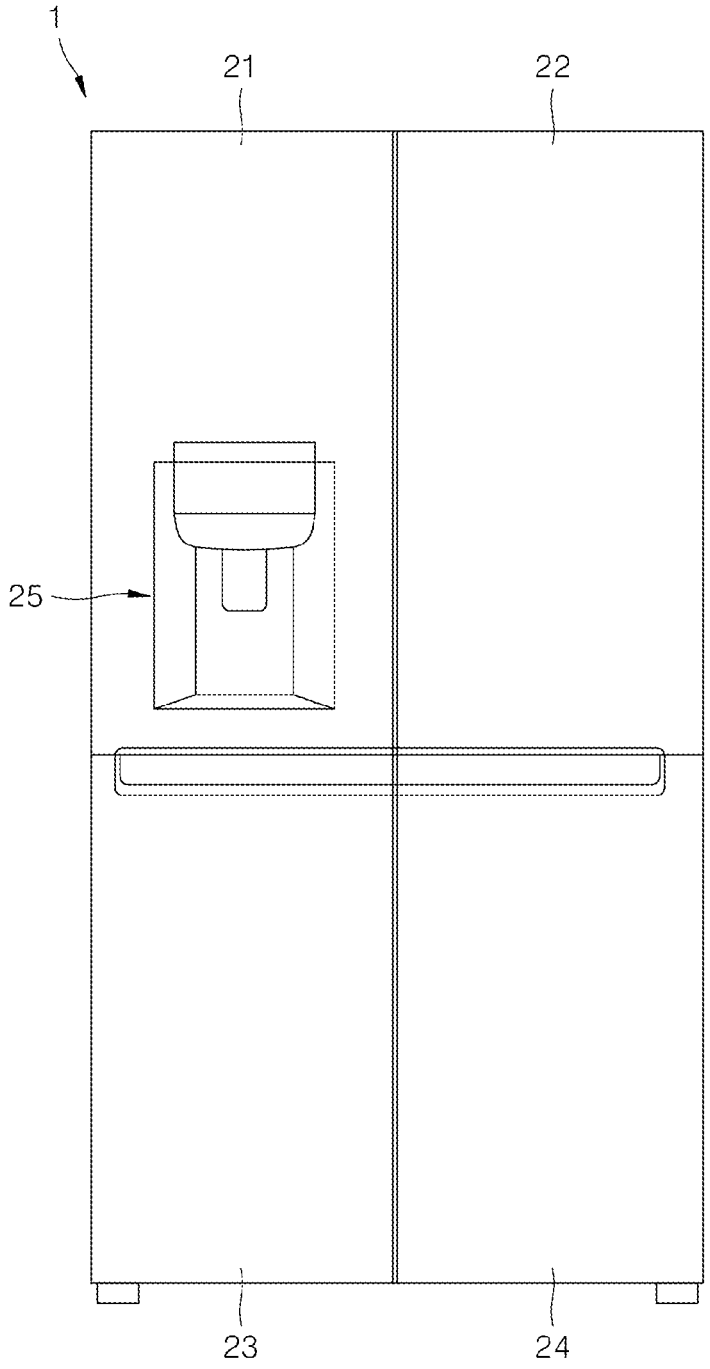
FIG. 1 is a front view showing a refrigerator of one embodiment.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the subject matter of disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component, unless stated to the contrary.

When any one component is described as being "in the upper portion (or lower potion)" or "on (or under)" another component, any one component can be directly on (or under) another component, but an additional component can be interposed between any one component and another component on (or under) any one component.

When any one component is described as being "connected", "coupled", or "connected" to another component, any one component can be directly connected or coupled to another component, but an additional component can be "interposed" between the two components or the two components can be "connected", "coupled", or "connected" by an additional component.

Throughout the disclosure, each component can be provided as a single one or a plurality of ones, unless explicitly stated to the contrary.

The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the phrase "A and/or B" as used herein can denote A, B or A and B, and the phrase "C to D" can denote C or greater and D or less, unless stated to the contrary.

Hereafter, a refrigerator comprising a container in several embodiments are described.

Figure 2:
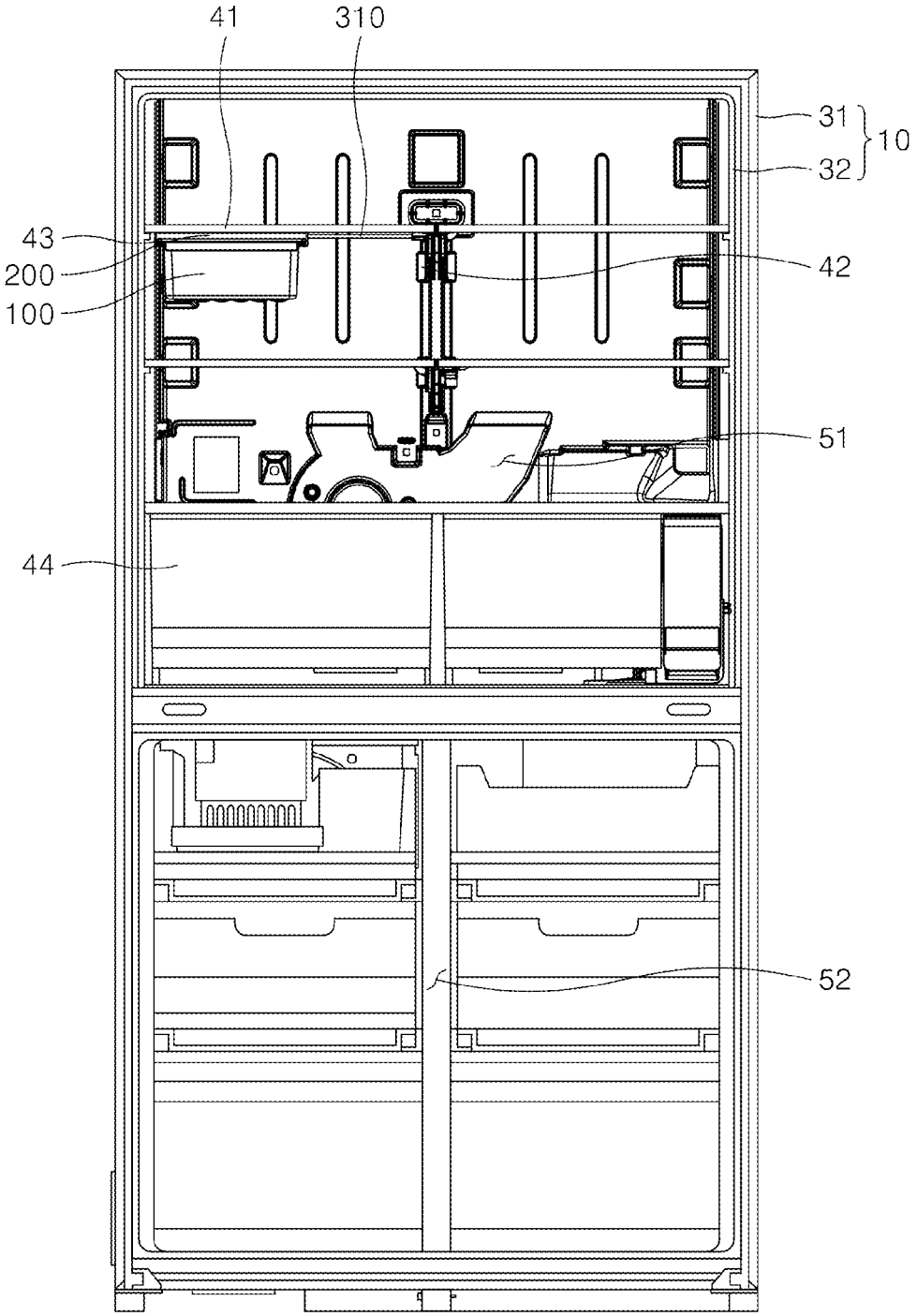
FIG. 2 is a front view showing the refrigerator of one embodiment without doors.

FIG. 1 is a front view showing a refrigerator 1 of one embodiment, and FIG. 2 is a front view showing the refrigerator 1 of one embodiment without doors.

The exterior of the refrigerator 1 may be formed by a cabinet 10 that has an open front surface and forms a storage, and doors 21, 22, 23, 24 that are capable of opening and closing the open front surface of the cabinet 10. The cabinet 10 may include an outer case 31 that forms the outer surface of the refrigerator 1, and an inner case 32 that forms the inner surface of the refrigerator 1. The storage may be defined by the inner surface of the inner case 32.

The outer case 31 and the inner case 32 may separate from each other and have a space therebetween. A thermal insulator may foam in the separation space, and the vacant separation space may be filled with the thermal insulator.

The storage in the cabinet 10 may be partitioned into a plurality of ones. For example, the storage of the cabinet 10 may be divided into a refrigerator compartment 51 and a freezer compartment 52.

In the present disclosure, the freezer compartment 52 is disposed in the lower space of the cabinet 10, and the refrigerator compartment 51 is disposed in the upper space of the cabinet 10, for example.

The doors may be disposed at the front of the cabinet 10, and open and close the refrigerator 1.

Upper doors may be disposed at the front of the cabinet 10, which corresponds to the refrigerator compartment 51, and lower doors may be disposed at the front of the cabinet 10, which corresponds to the freezer compartment 52. The upper doors may include a first upper door 21 and a second upper door 22 that respectively have a rotation axis at both sides of the cabinet, and rotate around the rotation axis, and the lower doors may include a first lower door 23 and a second lower door 24 that respectively have a rotation axis at both sides of the cabinet and rotate around the rotation axis.

The first upper door 21 may have a dispenser part 25 (or a dispenser) used to take out cold water or ice, without the door open.

The refrigerator 1 of one embodiment may include at least one or more of shelves 41 (or lower surfaces of a drawer or an inner surface of the storage) that are disposed in the storage of the cabinet 10 and partition the storage. The refrigerator 1 of one embodiment may further include shelf supports 42, 43 that support the shelves 41. The shelf supports 42, 43 may include a first shelf support 42, and a second shelf support 43. The first shelf support 42 and the second shelf support 43 may support both ends of a shelf 41 in the left-right direction.

The first shelf support 42 may be disposed at the center of the storage in the left-right direction. The first shelf support 42 may be fixed to the rear surface of the inner case 32. The second shelf support 43 may be disposed at one of both the sides of the storage in the left-right direction.

The second shelf support 43 may be disposed on one of the left surface and the right surface of the inner case 32. The second shelf support 43 may be formed on the left surface and/or the right surface of the inner case 32. That is, a portion of the left surface and/or the right surface of the inner case 32 may be formed to support the lateral end of the shelf 41.

The refrigerator 1 of one embodiment may include at least one first guide means. The first guide means may include an installation bar 310. The installation bar 310 may be disposed in the storage of the refrigerator. For example, the installation bar 310 may be disposed under the shelf 41. The installation bar 310 may be disposed in the storage so as to extend in the left-right direction. The refrigerator 1 of one embodiment may include at least one bar holder supporting the at least one installation bar 310. The at least one installation bar 310 may be inserted and/or mounted to the at least one bar holder. For the installation bar 310 to be installed, a bar holder may be disposed at the first shelf support 42 and the second shelf support 43.

The refrigerator 1 of one embodiment may include a holder 200. The holder 200 may be detachably coupled to the first guide means, e.g. the installation bar 310, 320. The holder 200 may include at least one second guide means. The second guide means may have a shape corresponding to a shape of the first guide means. The second guide means may relative move with respect to the first guide means. The second guide means may include at least one mounting part 210, 220 including an opening. The at least one mounting part 210, 220 may be disposed in an upper portion of the holder 200 and/or in rear portion of the holder 200. The installation bar 310 may be inserted in the opening. The holder 200 may include at least one holder rail being movably coupled to an upper portion of the storing part 100.

The refrigerator 1 of one embodiment may include a storing part 100. The storing part 100 may be a storage bin, a storage container, or a storage tray. The storing part 100 may be detachably coupled to the holder 200. The storing part 100 may be movably coupled to the holder 200 in a front-rear direction. The storing part 100 may include at least one storing part rail being movably coupled to the at least one holder rail.

Figure 3:
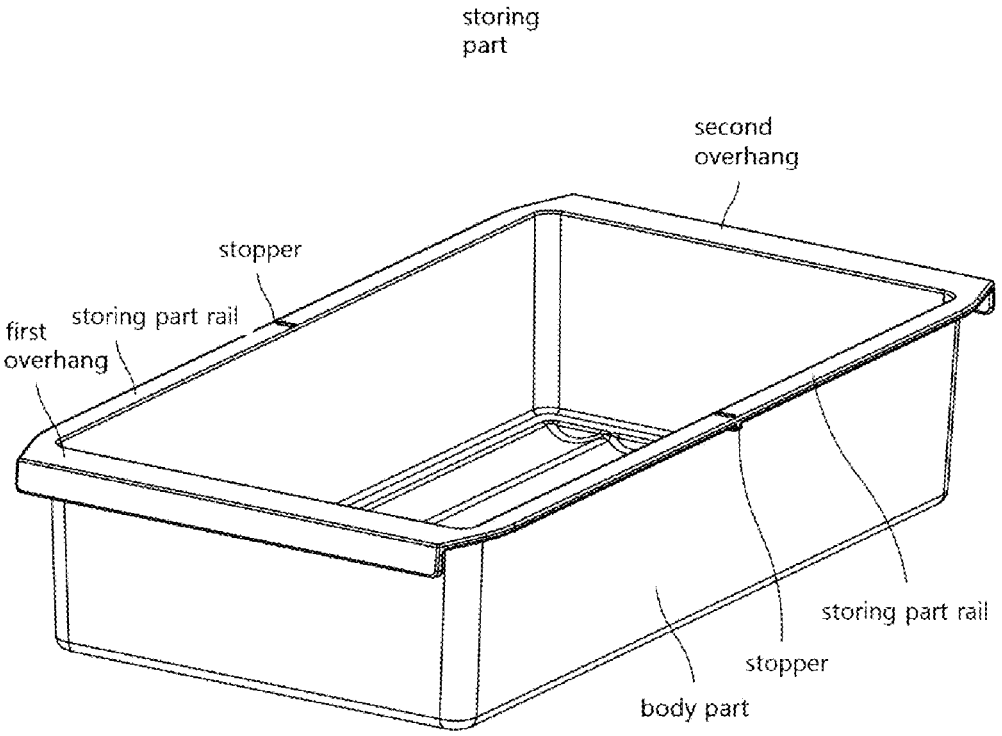
FIG. 3 is a perspective view showing a storing part of a container of one embodiment.
Figure 4:
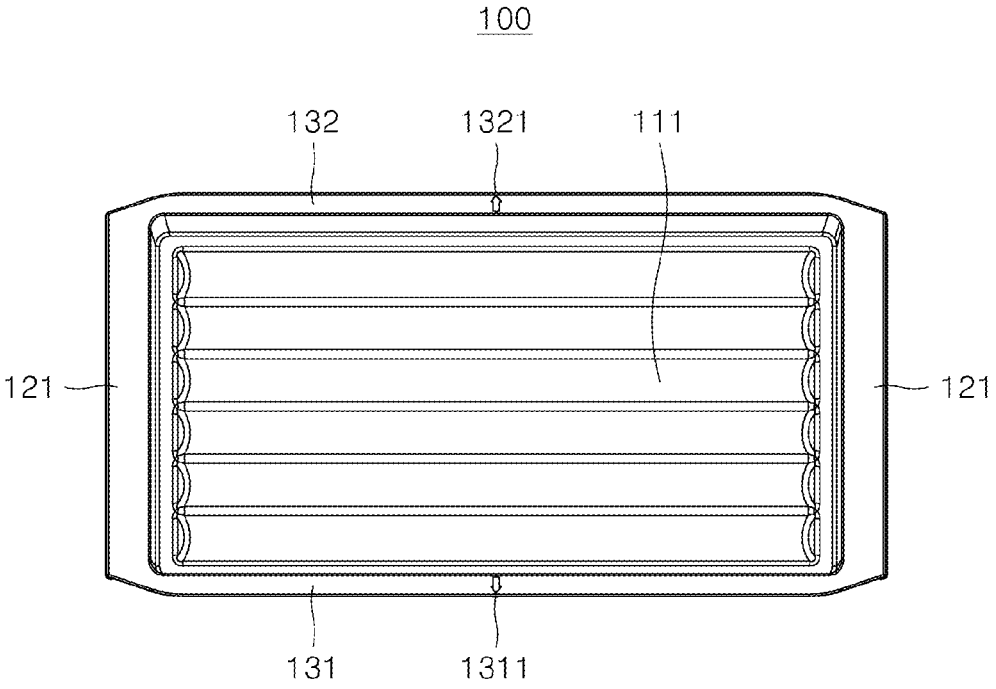
FIG. 4 is a plan view showing the storing part of the container of one embodiment.
Figure 5:
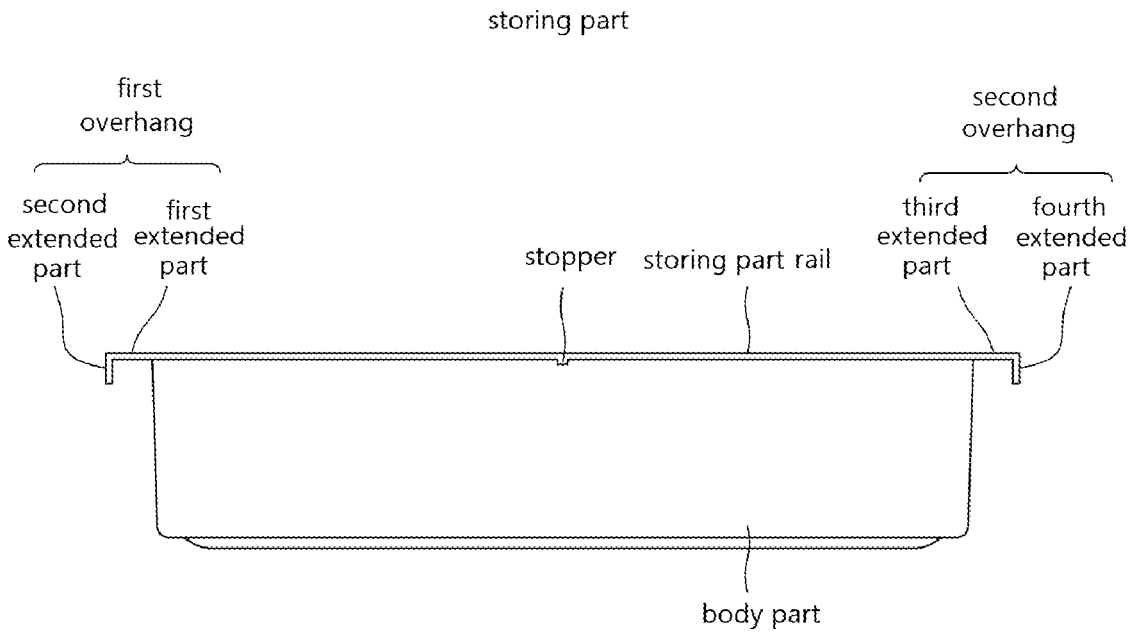
FIG. 5 is a side view showing the storing part of the container of one embodiment.
Figure 6:
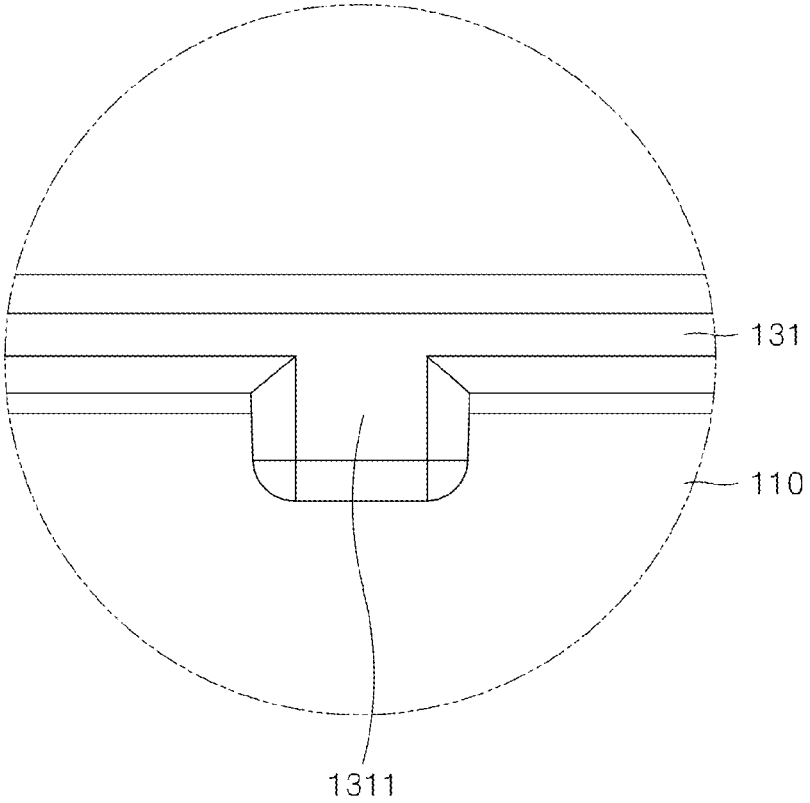
FIG. 6 is an enlarged view showing a stopper of the storing part of the container of one embodiment.

FIG. 3 is a perspective view showing a storing part 100 of a container of one embodiment, FIG. 4 is a plan view showing the storing part 100 of the container of one embodiment, FIG. 5 is a side view showing the storing part 100 of the container of one embodiment, and FIG. 6 is an enlarged view showing a stopper 1311 of the storing part 100 of the container of one embodiment.

In one embodiment of the present disclosure, the storing part 100 may include a body part 110 (or a body) forming a storage space.

The body part 110 may have an approximate hexahedron shape, and an open upper portion. A groove part 111 (or a groove or a plurality of grooves) may be formed on the bottom surface of the body part 110. The groove part 111 may prevent storage targets stored in the storage space of the body part 110 from shaking. For example, in the case where cans or bottles and the like are stored in the storage space of the body part 110, the groove part 111 may prevent the cans or the bottles and the like from rolling around in the storage space.

In one embodiment of the present disclosure, the storing part 100 may include at least one overhang 121, 122 extended from side of the upper portion of the body part 110 to the outside of the body part 110. When the storing part 100 is coupled to the holder 200, the at least one overhang 121, 122 may function as handle. For example, when the storing part 100 is coupled to the holder 200, the at least one overhang 121, 122 may be used to move the storing part 100 in the front-rear direction. When the storing part 100 is coupled to the storage drawer 44, the at least one overhang 121, 122 may function as a mounting part or a support. The at least one overhang 121, 122 may include a first overhang 121 and a second overhang 122. Each of the first overhang 121 and the second overhang 122 may be disposed at both sides of the body part 110 in a first direction, respectively. Each of the first storing part rail 131 and the second storing part rail 132 may be disposed at both sides of the body part 110 in a second direction that is orthogonal to the first direction, respectively.

The first overhang 121 may include a first extended part 1211, and a second extended part 1212. The second overhang 122 may include a third extended part 1221, and a fourth extended part 1222. The first extended part 1211 may be extended from one side of the upper portion of the body part 110 to the outside of the body part 110 along the first direction. The second extended part 1212 may be extended downward from the first extended part 1211. The third extended part 1221 may be extended from the other side of the upper portion of the body part 110 to the outside of the body part 110 along the first direction. The fourth extended part 1222 may be extended downward from the third extended part 1221.

In one embodiment of the present disclosure, the storing part 100 may include at least one storing part rail 131, 132. The at least one storing part rail 131, 132 may be extended from a side of the upper portion of the body part 110. The at least one storing part rail 131, 132 may be moveably coupled to at least one holder rail 230, 240 of the holder 200. The at least one storing part rail 131, 132 may include a first storing part rail 131 (or a first storage rail) and a second storing part rail 132 (or a second storage rail). The first storing part rail 131 may be extended from one side of the upper portion of the body part 110 to the outside of the body part 110 along the second direction. The second storing part rail 132 may be extended from the other side of the upper portion of the body part 110 to the outside of the body part 110 along the second direction. The first stopper 1311 may be formed at the center of the first storing part rail 131 with respect to the first direction. The second stopper 1321 may be formed at the center of the second storing part rail 132 with respect to the first direction.

Figure 7:
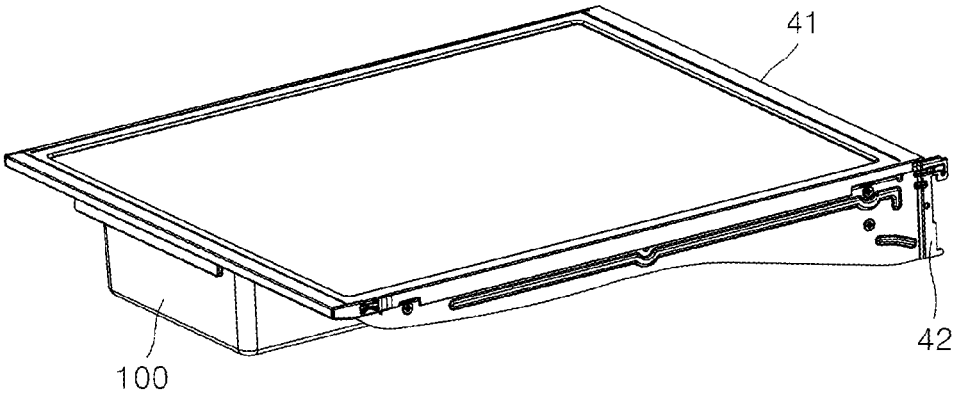
FIG. 7 is a perspective view showing the container of one embodiment being mounted on a shelf.

As illustrated in FIGS. 2 and 7 and the like, the storing part 100 may be detachably coupled to the holder 200. In this case, the storing part 100 may be disposed under the shelf 41. Also, the first direction of the storing part 100 may be a front-rear direction. That is, the storing part 100 may be disposed in a way that the first overhang 121 or the second overhang 122 of the storing part 100 faces the front. At this time, the first overhang 121 or the second overhang 122 may serve as a handle. Additionally, each of the first storing part rail 131 and the second storing part rail 132 may be movably supported by a first holder rail 230 and a second holder rail 240 of the holder 200.

Figure 15:
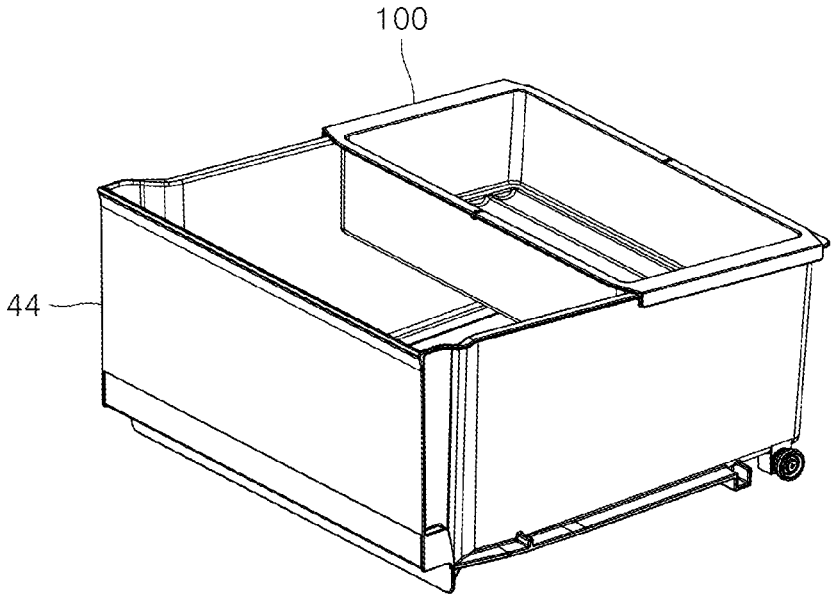
FIG. 15 is a perspective view showing the storing part of the container of one embodiment being mounted in a storage drawer of the refrigerator.

As illustrated in FIG. 15 and the like, the storing part 100 may be detachably coupled to the storage drawer 44. In this case, the storing part 100 may be disposed in a storage drawer 44. Also, the second direction of the storing part 100 may be a front-rear direction. That is, the storing part 100 may be disposed in a way that the first storing part rail 131 or the second storing part rail 132 of the storing part 100 faces the front. At this time, the first overhang 121 and the second overhang 122 may serve as a mounting part that allows the storing part 100 to be mounted to the storage drawer 44. That is, the upper end of the storage drawer 44 may be inserted into a space that is formed by the first overhang 121 and the second overhang 122.

Figure 8:
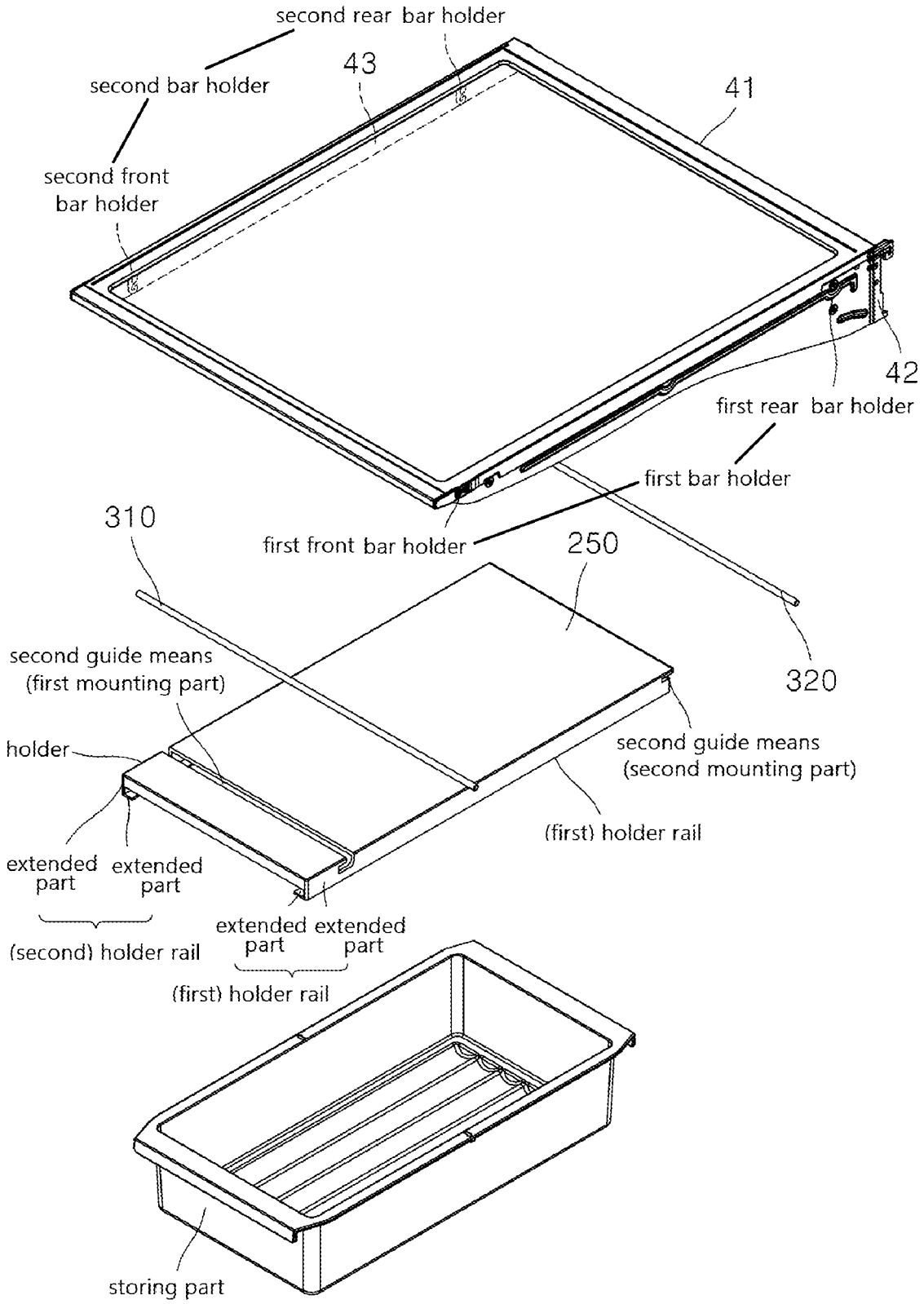
FIG. 8 is an exploded perspective view showing the container in FIG. 7.
Figure 9:
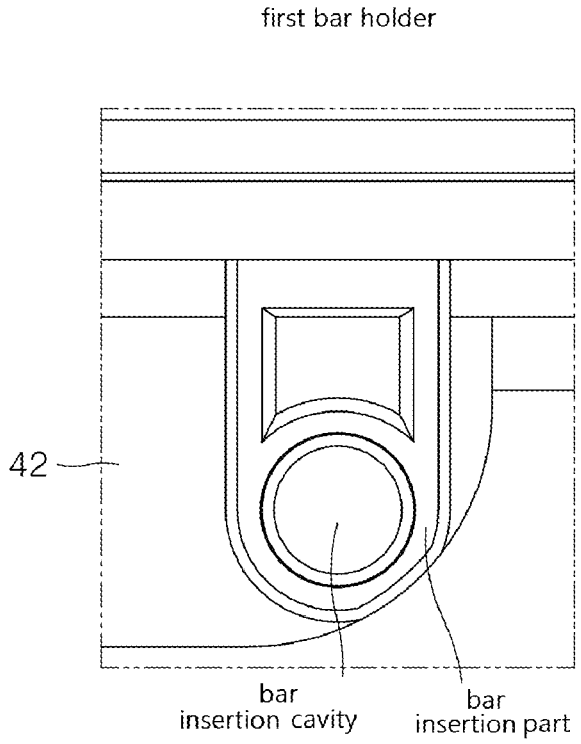
FIG. 9 is a view showing a first front bar holder of the container of one embodiment.
Figure 10:
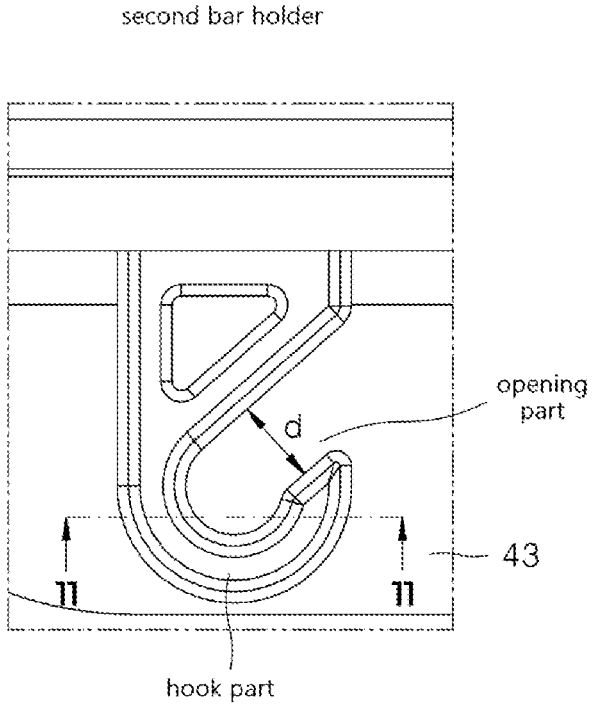
FIG. 10 is a view showing a second front bar holder of the container of one embodiment.
Figure 11:
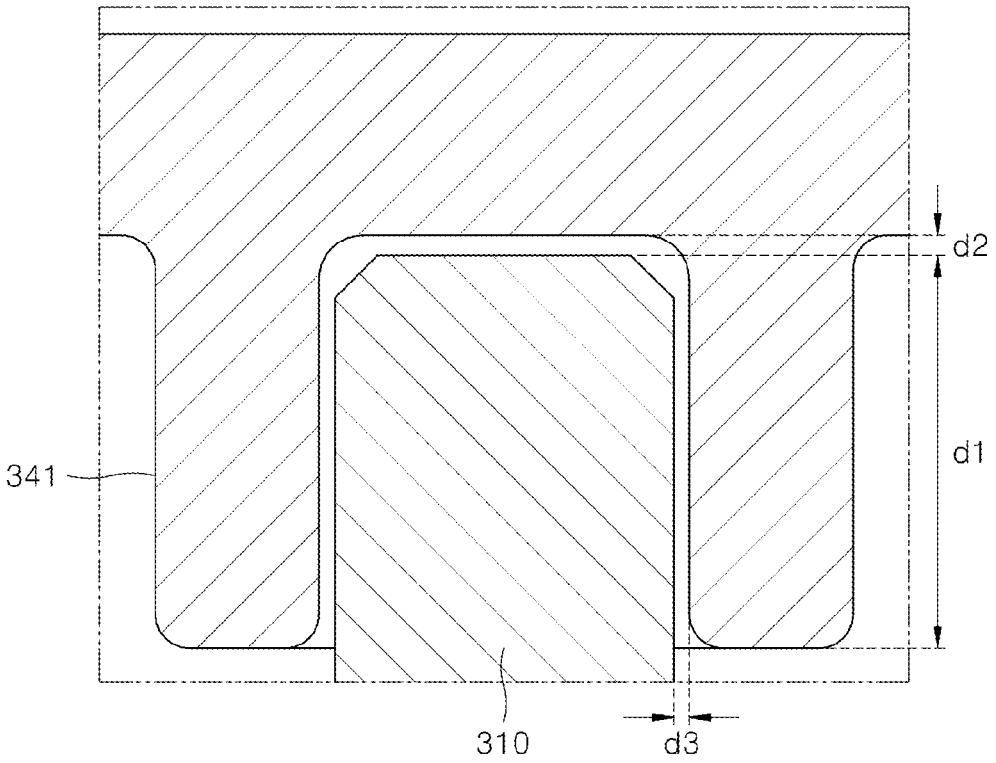
FIG. 11 is a cross-sectional view showing the second front bar holder of the container of one embodiment.
Figure 12:
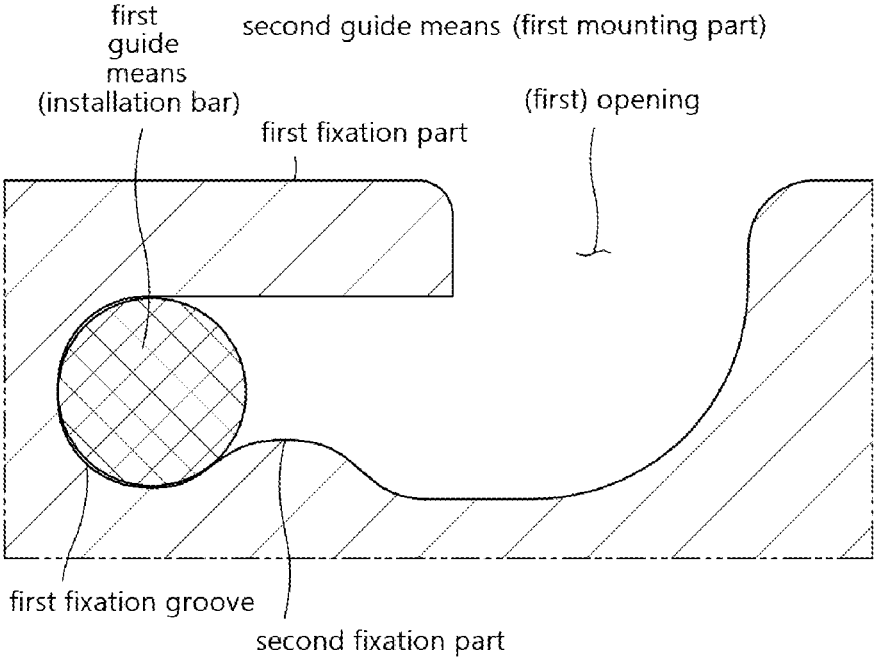
FIG. 12 is a view showing a first mounting part of a holder of the container of one embodiment.
Figure 13:
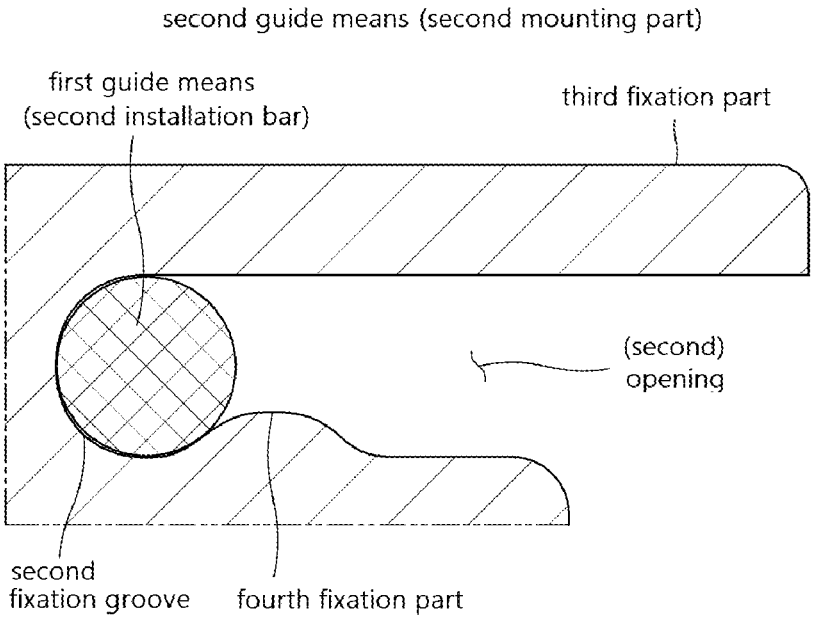
FIG. 13 is a view showing a second mounting part of the holder of the container of one embodiment.

FIG. 7 is a perspective view showing the container of one embodiment being mounted on a shelf part (more particularly, a shelf support), FIG. 8 is an exploded perspective view showing the container in FIG. 7, FIG. 9 is a view showing a first front bar holder of the container of one embodiment, FIG. 10 is a view showing a second front bar holder of the container of one embodiment, FIG. 11 is a view for describing the state where an installation bar is inserted into the bar holder of the container of one embodiment, FIG. 12 is a view showing a first mounting part of a holder of the container of one embodiment, and FIG. 13 is a view showing a second mounting part of the holder of the container of one embodiment.

The container of one embodiment in the present disclosure may include the storing part 100 described above.

The container of one embodiment in the present disclosure may include at least one bar holder 331, 332, 341, 342. The at least one bar holder may include a first bar holder 331, 332, and a second bar holder 341, 342. The first bar holder 331, 332 and the second bar holder 341, 342 may be disposed in the same position, with respect to the front-rear direction and heightwise direction of the refrigerator. The first bar holder 331, 332 and the second bar holder 341, 342 may be spaced from each other in the left-right direction of the refrigerator. The first bar holder 331, 332 may include a first front bar holder 331 and a first rear bar holder 332. The second bar holder 341, 342 may include a second front bar holder 341, and a second rear bar holder 342. The first bar holder 331, 332 may be disposed at the first shelf support 42, and the second bar holder 341, 342 may be disposed at the second shelf support 43. The first front bar holder 331 and the second front bar holder 341 may be disposed at the fronts of the first shelf support 42 and the second shelf support 43, with respect to the front-rear direction. Specifically, the first front bar holder 331 and the second front bar holder 341 may be disposed in the same position, with respect to the front-rear direction and heightwise direction of the refrigerator. Additionally, the first front bar holder 331 and the second front bar holder 341 may be spaced from each other in the left-right direction of the refrigerator. The first rear bar holder 332 and the second rear bar holder 342 may be disposed at the rears of the first shelf support 42 and the second shelf support 43, with respect to the front-rear direction. Specifically, while the first rear bar holder 332 and the second rear bar holder 342 are disposed in the same position with respect to the front-rear direction and heightwise direction of the refrigerator, the first rear bar holder 332 and the second rear bar holder 342 may be disposed at the rears of the first front bar holder 331 and the second front bar holder 341. Further, the first rear bar holder 332 and the second rear bar holder 342 may be spaced from each other in the left-right direction of the refrigerator. The first installation bar 310 may be detachably mounted in the first front bar holder 331 and the second front bar holder 341. The second installation bar 320 may be detachably mounted in the first rear bar holder 332 and the second rear bar holder 342.

Although not shown, the number of bar holders and the number of installation bars may be appropriately selected as needed. For example, the container according to one embodiment may include two bar holders and one installation bar. Alternatively, one installation bar may be supported by one bar holder.

In addition, although not shown, the installation bar may be supported by other components of the refrigerator (for example, an arbitrary structure disposed on the inner case 32) other than the bar holder. Alternatively, the installation bar may be directly mounted on the inner case 32 of the refrigerator or other components of the refrigerator. The installation bar may be placed under the shelf of the refrigerator.

The bar holders are described with reference to FIGS. 9 to 11. FIG. 11 is a view for describing the state in which the installation bar is mounted in the bar holder, and a cross-sectional view (a cross-sectional view along 11-11' in FIG. 10) representatively showing that the first installation bar 310 is mounted in the second front bar holder 341. However, the cross-sectional views of the first front bar holder 331, the first rear bar holder 332, and the second rear bar holder 342, in which the installation bar is mounted, are substantially the same as the cross-sectional view of the second front bar holder 341, in which the installation bar is mounted, in FIG. 11.

The first front bar holder 331 may include a first bar insertion part 3311 that forms a first bar insertion cavity 3312 into which one end of the first installation bar 310 is inserted. The first bar insertion part 3311 may have a cylinder shape as a whole. The depth (d1 in FIG. 11) of the first bar insertion cavity 3312 formed by the first bar insertion part 3311 may be about 5 mm. Additionally, in the state where the first installation bar 310 is installed, a distance (d2 in FIG. 11) between the bottom surface of the first bar insertion cavity 3312 and one end of the first installation bar 310 may be about 0.25 mm. Further, in the state where the first installation bar 310 is installed, a gap (d3 in FIG. 11) between the first bar insertion part 3311 and the first installation bar 310 may be about 0.1 mm. Although not shown, the first bar insertion part 3311 may have a polygonal column shape as a whole.

The first rear bar holder 332 may have the same structure as the first front bar holder 331.

The second front bar holder 341 may include a first hook part 3411 (or a first hook) to which the first installation bar 310 can be fixed. The first hook part 3411 may form a first open part 3412 (or a first opening) through which the first installation bar 310 is enters or exits. The size d of the first open part 3412 may be defined as a straight line distance from the end portion of the first hook part 3411 to a structure at the opposite side of the first hook part 3411, and the size of the first open part 3412 may be about 90% of the size of the first installation bar 310. Thus, the first installation bar 310 may be mounted in a mounting space that is defined by the first hook part 3411, through the first open part 3412, based on a press fit.

The depth (d1 in FIG. 11) of the first hook 3411 may be about 5 mm. Additionally, in the state where the first installation bar 310 is installed, a distance (d2 in FIG. 11) between the bottom surface of the mounting space that is formed by the first hook 3411 (or the first shelf support 42) and one end of the first installation bar 310 may be about 0.25 mm. Further, in the state where the first installation bar 310 is installed, a gap (d3 in FIG. 11) between the first hook 3411 and the first installation bar 310 may be about 0.1 mm.

The second rear bar holder 342 may have the same structure as the second front bar holder 341.

The container of one embodiment in the present disclosure may include a holder 200. The holder 200 may be detachably mounted to the first installation bar 310 and/or the second installation bar 320. Additionally, the holder 200 may move in a first direction along the first installation bar 310 and/or the second installation bar 320. The first direction may be a left-right direction of the refrigerator 1. Further, the storing part 100 may be detachably mounted to the holder 200. The storing part 100 may be movably mounted to the holder in a second direction. The second direction may be a front-rear direction of refrigerator 1.

The holder 200 may include a first holder rail 230, a second holder rail 240. The first storing part rail 131 (or the second storing part rail 132) of the storing part 100 may be inserted into the first holder rail 230, and the second storing part rail 132 (or the first storing part rail 131) may be inserted into the second holder rail 240. That is, the storing part 100 may be mounted between the first holder rail 230 and the second holder rail 240 in a way that the storing part 100 moves in the front-rear direction.

The holder 200 may further include a connection part 250 (or a connection surface). The connection part 250 may connect between the upper portion of the first holder rail 230 and the upper portion of the second holder rail 240. The connection part 250 may have a flat plate shape as a whole.

The first holder rail 230 may include a first extended part 231 (or a first extension) that is extended downward from the connection part 250, and a second extended part 232 (or a second extension) that is extended laterally from the first extended part 231 toward the lower side of the connection part 250. The second holder rail 240 may include a third extended part 241 (or a third extension) that is extended downward from the connection part 250, and a fourth extended part 242 (or a fourth extension) that is extended laterally from the third extended part 241 toward the lower side of the connection part 250.

The holder 200 may further include a mounting part 210, 220 (or a mounting component) for allowing the holder 200 to be movably mounted in the installation bar 310, 320. The mounting part 210, 220 may include a first mounting part 210 (or a first mounting component) and a second mounting part 220 (or a second mounting component). For example, the connection part 250 may have the first mounting part 210 and the second mounting part 220 for allowing the holder 200 to be movably mounted in (or along) the first installation bar 310 and the second installation bar 320.

The first mounting part 210 may be disposed at the front of the upper surface of the holder 200. That is, the first mounting part 210 may be disposed at the front of the connection part 250 of the holder 200. The first mounting part 210 may include a first fixation part 211 that is extended in the front-rear direction, a second fixation part 212 that is disposed below the first fixation part 211, and a first fixation groove 213 (or a first groove) that is formed between the first fixation part 211 and the second fixation part 212. A first opening 214 may be formed between the end of the first fixation part 211 and the connection part 250. The first opening 214 may be formed in a way that passes through the connection part 250 in the up-down direction. The second fixation part 212 may be convexly formed upward. Accordingly, the first installation bar 310 may be disposed in the first fixation groove 213, based on a press fit.

The second mounting part 220 may be disposed at the rear of the upper surface of the holder 200. That is, the second mounting part 220 may be disposed at the rear of the connection part 250 of the holder 200. The second mounting part 220 may include a third fixation part 221 that is extended in the front-rear direction, a fourth fixation part 222 that is disposed below the third fixation part 221, and a second fixation groove 223 (or a second groove) that is formed between the third fixation part 221 and the fourth fixation part 222. A second opening 224 may be formed under the third fixation part 221. The second opening 224 may be formed in a way that penetrates from the rear of the holder 200 in the front-rear direction. The fourth fixation part 222 may be convexly formed upward. Accordingly, the second installation bar 320 may be disposed in the second fixation groove 223, based on a press fit.

Figure 14:
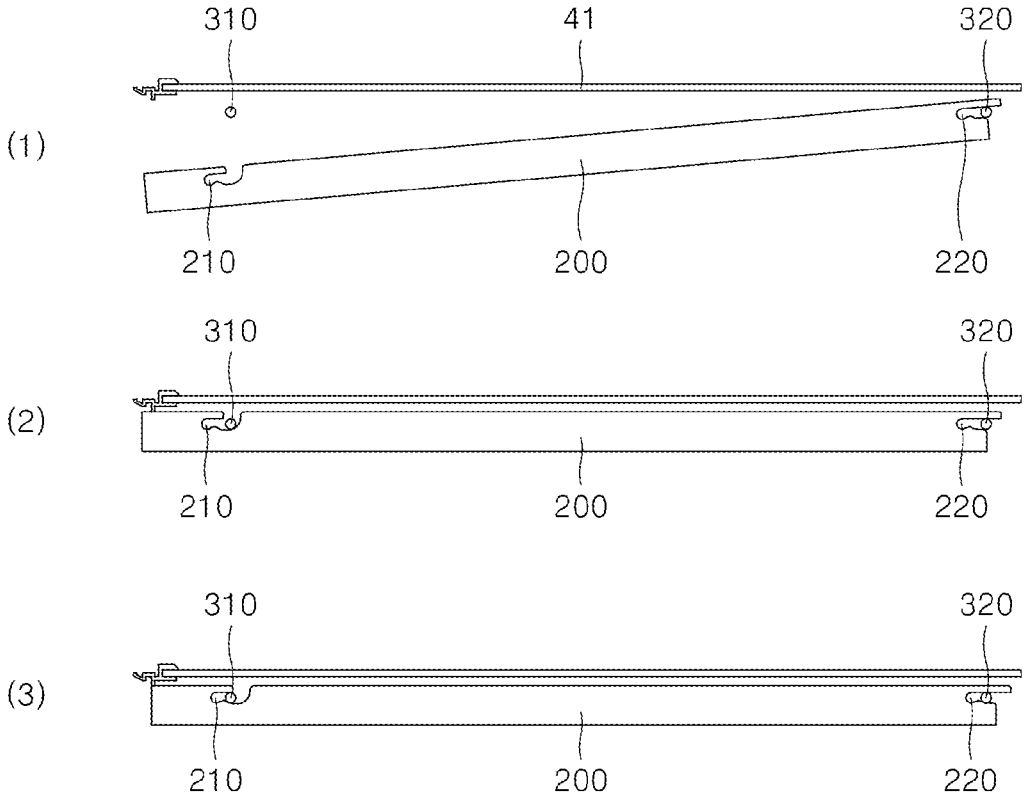
FIG. 14 is a view showing a process of mounting the holder of the container of one embodiment.

FIG. 14 is a view showing a process of mounting the holder 200 of the container of one embodiment.

Referring to FIG. 14(1), the holder 200 is positioned to allow the second installation bar 320 to be inserted into the second opening 224 of the second mounting part 220. In this state, the rear portion of the third fixation part 221 of the second mounting part 220 may be hung on the upper side of the second installation bar 320.

Then, referring to FIG. 14(2), in the state where the third fixation part 221 of the second mounting part 220 is hung on the second installation bar 320, the front portion of the holder 200 is moved upward to insert the first installation bar 310 to be inserted into the first opening 214 of the first mounting part 210.

Then, referring to FIG. 14(3), the holder 200 is pushed backward to place the first installation bar 310 at the rear of the second fixation part 212 of the first mounting part 210, and to place the second installation bar 320 at the rear of the fourth fixation part 222 of the second mounting part 220. In the state shown in FIG. 14(3), based on a press fit, the first installation bar 310 may be positioned in the first fixation groove 213 of the first mounting part 210, and the second installation bar 320 may be positioned in the second fixation groove 223 of the second mounting part 220.

The holder may be removed, in the opposite order to the order shown in FIG. 14.

In the above-described structure, the storing part 100 may be disposed at the lower side of a shelf, without a structure for installing the storing part 100 at the upper side of the shelf. Accordingly, the storing part 100 may be placed under the shelf, causing no inconvenience at a time when an item is stored on the shelf. Thus, the storage of the refrigerator may be used effectively.

In the embodiment described above and shown in the drawings, the installation bars 310 and 320 and the mounting parts 210 and 220 are applied as the first guide means and the second guide means, respectively. Alternatively, other configurations as a first guide means and a second guide means for moving the holder 200 in the first direction are also applicable. For example, the first guide means may be a protrusion extending in a first direction, and the second guide means may be a groove having a shape accommodating the protrusion and disposed in the holder 200 so as to be capable of relative movement with respect to the protrusion. As another example, the second guide means may be a protrusion disposed on the holder 200 and extending in the first direction, and the first guide means may be a groove having a shape accommodating the protrusion.

In addition, in the above-described embodiment, the first guide means is fixed to the shelf supports 42 and 43. Alternatively, the first guide means may be fixed to the lower surface of the shelf or to a separate member extending from the lower surface of the shelf. Also, when the holder 200 is used without being combined with a shelf, the first guide means may be fixed to the inner wall of the refrigerator 1. When the holder 200 is disposed in a large storage drawer 44, the first guide means may be fixed in the storage drawer 44.

In the embodiment described above, the first direction in which the holder 200 moves is the left-right direction of the refrigerator, and the second direction in which the storing part 100 coupled with the holder 200 moves is the front-rear direction of the refrigerator 1. The first direction and the second direction may be different from those described above. For example, when the first guide means has a structure extending in the front-rear direction of the refrigerator, the first direction in which the holder moves is the front-rear direction of the refrigerator 1, and the second direction in which the storing part 100 coupled with the holder moves may be in the left-right direction of the refrigerator 1. More particularly, when the holder 200 is disposed in the large-sized storage drawer 44 and the first guide means is fixed in the storage drawer 44 along the front-rear direction of the refrigerator 1, the holder is movable in the front-rear direction of the refrigerator 1, and the storing part 100 coupled to the holder 200 is movable in the left-right direction of the refrigerator 1.

Figure 16:
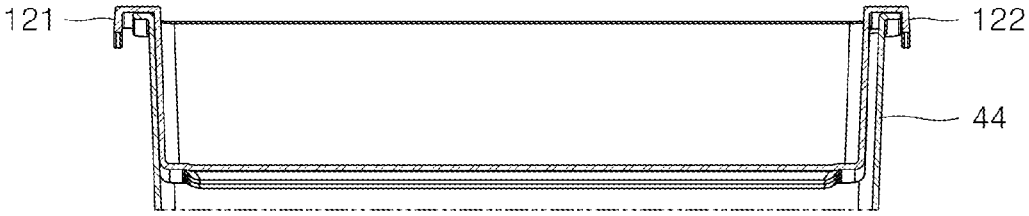
FIG. 16 is a cross-sectional view showing the storing part of the container of one embodiment being mounted in a storage drawer of the refrigerator.
Figure 17:
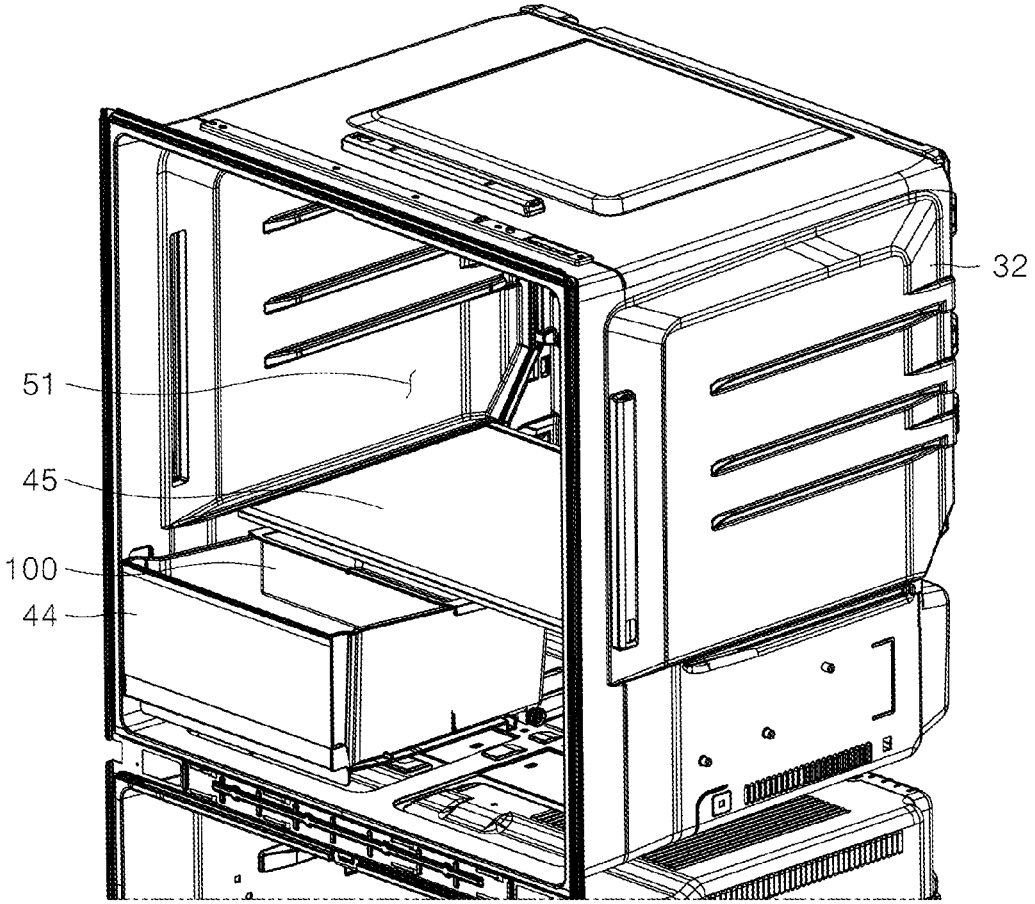
FIG. 17 is a perspective view showing that the storage drawer in which the storing part is mounted is open.
Figure 18:
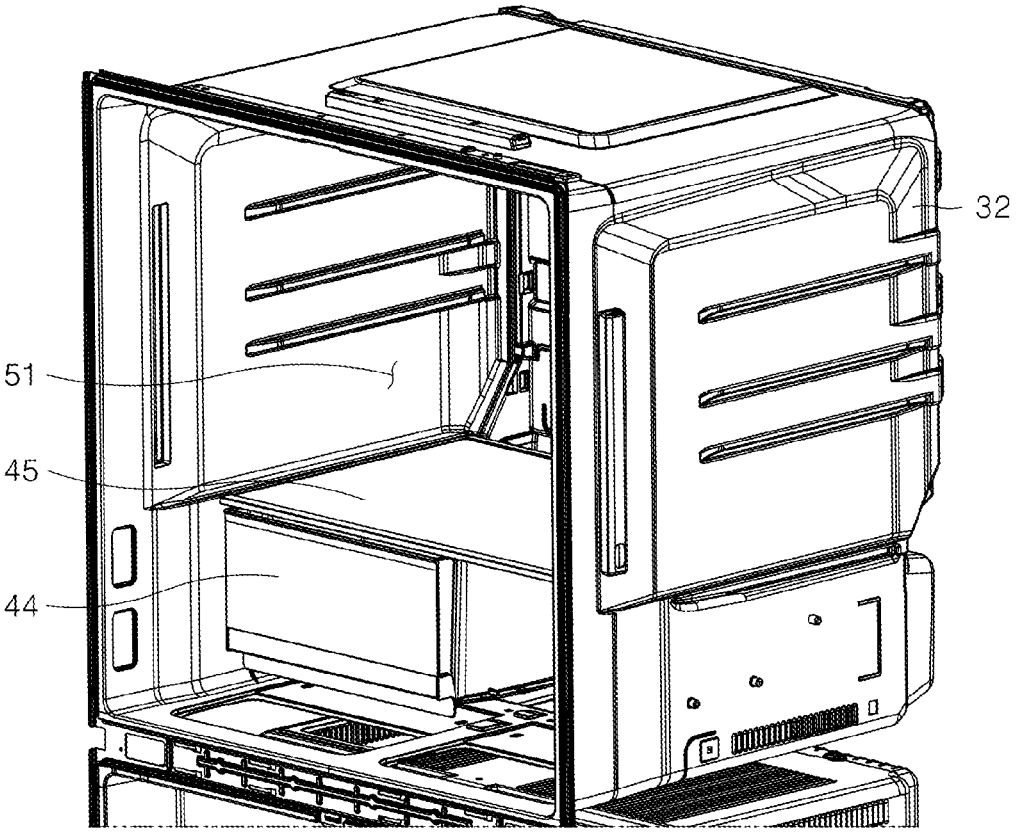
FIG. 18 is a perspective view showing the storage drawer in which the storing part is mounted is closed.

FIG. 15 is a perspective view showing the storing part 100 of the container of one embodiment being mounted in a storage drawer 44 of the refrigerator, FIG. 16 is a cross-sectional view showing the storing part 100 of the container of one embodiment being mounted in a storage drawer 44 of the refrigerator, FIG. 17 is a perspective view showing that the storage drawer 44 in which the storing part 100 is mounted is open, and FIG. 18 is a perspective view showing the storage drawer 44 in which the storing part 100 is mounted is closed.

The storing part 100 may be mounted at the upper end of the storage drawer 44 in the state where the first direction of the storing part 100 is the widthwise direction of the storage drawer 44. To this end, the length of the body part 110 of the storing part 100 in the first direction, i.e., the length of the body part 110 between the first overhang 121 and the second overhang 122 of the storing part 100, may be less than the width of the loading space of the storage drawer 44. Additionally, the entire length of the storing part 100 in the first direction, i.e., a distance between the 1-2 extended part 1212 of the first overhang 121 and the 2-2 extended part 1222 of the second overhang 122 of the storing part 100, may be greater than the entire width of the storage drawer 44.

When the storage drawer 44 is open, the storing part 100 may be hidden under a shelf 45 that is disposed over the storage drawer 44. That is, when the storage drawer 44 is open, the length of the storing part 100 in the second direction (a distance between the first storing part rail 131 and the second storing part rail 132 of the storing part 100) may be the same as the length of a portion of the storage drawer 44, which is disposed under the shelf 45, in the front-rear direction.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

In one embodiment of the present disclosure, provided is a refrigerator including a container that can ensure the efficient use of a storage.

In one embodiment of the present disclosure, provided is a refrigerator including a container with a storing part, storing a small amount of storage targets and being installed in various spaces.

In one embodiment of the present disclosure, provided is a refrigerator including a container attached and detached from the refrigerator easily.

A refrigerator, in one embodiment, includes a cabinet forming a storage, a first guide means being disposed in the storage, a holder being detachably coupled to the first guide means and including a second guide means configured to guide movement in a first direction, and a storing part defining a storage space, being coupled to the holder, and movable in a second direction different from the first direction.

In refrigerator of one embodiment, the first guide means and the second guide means may perform relative motion. Alternatively, the second guide means may be relatively movable with respect to the first guide means.

In refrigerator of one embodiment, the first direction is left-right direction of the refrigerator, and the second direction is front-rear direction of the refrigerator.

In refrigerator of one embodiment, the holder may include at least one holder rail being movably coupled to an upper portion of the storing part so that the storing part is movable in the second direction.

In refrigerator of one embodiment, the storing part may further include a body part forming a storage space, and at least one storing part rail extended from an upper portion of the body part to an outside of the body part, and configured to be movably coupled to the pair of holder rails so that the storing part is movable in the second direction.

In refrigerator of one embodiment, the first guide means may include an installation bar extending in left-right direction of the refrigerator, and the second guide means may include a mounting part supported by the installation bar.

In refrigerator of one embodiment, the mounting part may include an opening provided in upper portion or rear portion of the holder to allow the installation bar to be inserted.

In refrigerator of one embodiment the installation bar may include a first installation bar, and a second installation bar being disposed at a rear of the first installation bar.

In refrigerator of one embodiment, the holder may include a first mounting part including a first opening that penetrates in an up-down direction to allow the first installation bar to be inserted, and a second mounting part including a second opening that penetrates in a front-rear direction to allow the second installation bar to be inserted.

The refrigerator of one embodiment may further include a first bar holder and a second bar holder. The first bar holder and the second bar holder may be disposed in the same height with respect to a height of the refrigerator. The first bar holder and the second bar holder may be spaced apart from each other in a left-right direction of the refrigerator. The first bar holder and the second bar holder may support the installation bar.

In refrigerator of one embodiment, the first bar holder may include a bar insertion part that forms a bar insertion cavity into which one end of the installation bar is inserted.

In refrigerator of one embodiment, the second bar holder may include a hook part that forms an opening part through which the installation bar enters or exits.

The refrigerator of one embodiment may further include a shelf configured to partition the storage.

In refrigerator of one embodiment, the first guide means may be disposed at a portion of the lower part of the shelf, an extension extending from the lower surface of the shelf, or a shelf support configured to support the shelf.

The refrigerator of one embodiment may further includes a shelf support configured to support the shelf from a lower portion of the shelf.

In refrigerator of one embodiment, the first bar holder and the second bar holder are disposed at the shelf support.

The refrigerator of one embodiment may further include a storage drawer being movably coupled to the cabinet. The storage drawer may form a second storage space.

In refrigerator of one embodiment, the storing part may be detachably and selectively coupled to the holder and the storage drawer.

In refrigerator of one embodiment, the storing part may include an overhang configured to function as a handle when the storing part is coupled to the holder, and configured to function as a mounting part supported by the storage drawer when the storing part is coupled to the storage drawer.

In refrigerator of one embodiment, the storing part may include a body part forming a first storage space, a pair of overhangs extended from an upper portion of the body part to an outside of the body part, and a pair of storing part rails extended from the upper portion of the body part to an outside of the body part, and configured to be movably coupled to the holder.

In refrigerator of one embodiment, the pair of overhangs may be disposed at both sides of the body part in a first direction, respectively.

In refrigerator of one embodiment, the pair of storing part rails may be disposed at both sides of the body part in a second direction that is orthogonal to the first direction, respectively.

In refrigerator of one embodiment, at least part of an upper portion of the storage drawer is inserted into a space defined by the pair of overhangs when the storing part is mounted to the storage drawer.

In refrigerator of one embodiment, a width of the second storage space in the left-right direction may be greater than a length of the body part in the first direction, and a width of the storage drawer in the left-right direction may be less than a distance between ends of the pair of overhangs.

In refrigerator of one embodiment, the first guide means may be fixed to an inner surface of the storage.

The refrigerator of one embodiment may further include a storage drawer being movably coupled to the cabinet and defining a second storage space. The first guide means may be fixed to the storage drawer.

The refrigerator of one embodiment may further include a shelf configured to partition the storage, and a storage drawer being movably coupled to the cabinet and defining a second storage space. The first guide means may include a protrusion protruding toward an inner surface of the storage, the shelf, or the storage drawer and extending in the first direction. The second guide means may include a groove having a shape accommodating the protrusion and relatively movable with respect to the protrusion.

The refrigerator of one embodiment may further include a shelf configured to partition the storage, and a storage drawer being movably coupled to the cabinet and defining a second storage space. The second guide means may be a protrusion disposed at the holder. The first guide means may be a groove having a shape accommodating the protrusion and provided in an inner surface of the storage, the shelf, or the storage drawer. The protrusion may be relatively movable with respect to the groove.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

In a refrigerator comprising a container of one embodiment, the efficient use of a storage may be ensured.

In the refrigerator comprising the container of one embodiment, a storing part and the container may be attached to and detached from the refrigerator easily.

In the refrigerator comprising the container of one embodiment, the storing part may be installed in various spaces.

In the refrigerator comprising the container of one embodiment, components constituting the container may all be at the lower side of a shelf of the refrigerator. Thus, storage targets may be stacked on the shelf of the refrigerator, causing no inconvenience.

Specific effects are described along with the above-described effects in the section of detailed description.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet to form a storage;

a first guide means including two installation bars extending in a first direction of the refrigerator and disposed to be detachably arranged in the storage, the two installation bars including a first installation bar and a second installation bar that are spaced apart in a second direction different from the first direction;

a holder including a connection part to be detachably coupled to the two installation bars, wherein the connection part includes a second guide means configured to guide movement of the holder in the first direction; and a storage tray having a storage space, the storage tray to couple to the holder, and the storage tray is configured to be movable in the second direction, wherein the first installation bar is positioned further forward than the first installation bar, and the second guide means includes a first mounting part that defines a first groove having a first opening at an upper surface of the holder to receive the first installation bar and a second mounting part that defines a second groove having a second opening at a rear surface of the holder to receive the second installation bar, wherein the first direction corresponds to the left-right direction of the refrigerator, the second direction corresponds to a front-rear direction of the refrigerator, and the holder is configured to be movable in the first direction while the storage tray remains coupled to the holder, wherein the first guide means further comprises a first bar holder and a second bar holder configured to be disposed in a same height with respect to a height of the refrigerator, being spaced from each other in the left-right direction of the refrigerator, and configured to support one of the installation bars, and wherein the refrigerator further comprises a shelf configured to partition the storage, and the first guide means is disposed at a lower part of the shelf, an extension extending from a lower surface of the shelf, or a shelf support configured to support the shelf.

2. The refrigerator of claim 1, wherein the holder includes at least one holder rail to be movably coupled to an upper portion of the storage tray.

3. The refrigerator of claim 2, wherein the storage tray comprises:

a body configured to form the storage space; and at least one storage rail extended from an upper portion of the body to outside of the body, and configured to be movably coupled to the at least one holder rail.

4. The refrigerator of claim 1, wherein the first bar holder includes a bar insertion part configured to form a bar insertion cavity to receive one end of the one of the installation bars, and wherein the second bar holder includes a hook that forms an opening configured to allow the one of the installation bars to enter or exit.

5. The refrigerator of claim 1, further comprising:

wherein the first bar holder and the second bar holder are disposed at the shelf support.

6. The refrigerator of claim 1, wherein the first guide means is further fixed to an inner surface of the storage.

7. The refrigerator of claim 1, further comprising:

a storage drawer to be movably coupled to the cabinet and configured to define another storage space, and wherein the first guide means is further coupled to the storage drawer.

8. A refrigerator, comprising:

a cabinet to form a storage;

a first guide including two installation bars extending in a first direction of the refrigerator and disposed to be detachably arranged in the storage, the two installation bars including a first installation bar and a second installation bar that are spaced apart in a second direction different from the first direction;

a holder including a connection part to be detachably coupled to the two installation bars, wherein the connection part includes a second guide configured to guide movement of the holder in the first direction; and a storage tray to couple to the holder, and the storage tray is configured to be movable in the second direction, wherein the first installation bar is positioned further forward than the first installation bar, and the second guide includes a first mounting part that defines a first groove having a first opening at an upper surface of the holder to receive the first installation bar, and a second mounting part that defines a second groove having a second opening at a rear surface of the holder to receive the second installation bar, wherein the first direction corresponds to the left-right direction of the refrigerator, the second direction corresponds to a front-rear direction of the refrigerator, and the holder is configured to be movable in the first direction while the storage tray remains coupled to the holder, wherein the first guide means further comprises a first bar holder and a second bar holder configured to be disposed in a same height with respect to a height of the refrigerator, being spaced from each other in the left-right direction of the refrigerator, and configured to support one of the installation bars, and wherein the refrigerator further comprises a shelf configured to partition the storage, and the first guide means is disposed at a lower part of the shelf, an extension extending from a lower surface of the shelf, or a shelf support configured to support the shelf.

9. The refrigerator of claim 8, wherein the holder includes at least one holder rail to be movably coupled to an upper portion of the storage tray, wherein the storage tray includes:

a body configured to form a storage space; and at least one storage rail that extends from an upper portion of the body to outside of the body, and configured to be movably coupled to the at least one holder rail.

10. A refrigerator, comprising:

a cabinet to form a storage;

two installation bars extending in a first direction of the refrigerator and disposed to be detachably arranged in the storage, the two installation bars including a first installation bar and a second installation bar that are spaced apart in a second direction different from the first direction;

a holder including a connection part to be detachably coupled to the installation bars, wherein the connection part includes a mounting part configured to guide movement of the holder in the first direction; and a storage tray to couple to at least one holder rail of the holder, and the storage tray is configured to be movable in the second direction, wherein the first installation bar is positioned further forward than the first installation bar, and the mounting part includes a first groove having a first opening at an upper surface of the holder to receive the first installation bar, and a second groove having a second opening at a rear surface of the holder to receive the second installation bar, wherein the first direction corresponds to the left-right direction of the refrigerator, the second direction corresponds to a front-rear direction of the refrigerator, and the holder is configured to be movable in the left-right direction while the storage tray remains coupled to the holder, wherein the first guide means further comprises a first bar holder and a second bar holder configured to be disposed in a same height with respect to a height of the refrigerator, being spaced from each other in the left-right direction of the refrigerator, and configured to support one of the installation bars, and wherein the refrigerator further comprises a shelf configured to partition the storage, and the first guide means is disposed at a lower part of the shelf, an extension extending from a lower surface of the shelf, or a shelf support configured to support the shelf.

* * * * *